United States Patent [19]

Buschor

[11] Patent Number: 4,993,645

[45] Date of Patent: Feb. 19, 1991

[54] SPRAY COATING DEVICE FOR ELECTROSTATIC SPRAY COATING

[75] Inventor: Karl Buschor, St. Gallen, Switzerland

[73] Assignee: Ransburg-Gema AG, Gallen, Switzerland

[21] Appl. No.: 470,869

[22] Filed: Jan. 25, 1990

[30] Foreign Application Priority Data

Feb. 14, 1989 [DE] Fed. Rep. of Germany ..... 3904438

[51] Int. Cl.[5] ..... B05B 5/00

[52] U.S. Cl. ..... 239/708; 118/629

[58] Field of Search ..... 118/629, 621; 239/706, 239/707, 708

[56] References Cited

U.S. PATENT DOCUMENTS

| | | | |
|---|---|---|---|
| 3,583,632 | 6/1971 | Shaffer et al. | 239/705 |
| 3,731,145 | 5/1973 | Senay | 239/708 |
| 4,196,465 | 4/1980 | Buschor | 118/621 |
| 4,287,552 | 9/1981 | Wagner et al. | 239/708 |
| 4,779,804 | 10/1988 | Baba et al. | 239/690 |

FOREIGN PATENT DOCUMENTS

| | | |
|---|---|---|
| 100854A1 | 2/1984 | European Pat. Off. . |
| 2025081 | 12/1970 | Fed. Rep. of Germany . |
| 2030388 | 1/1971 | Fed. Rep. of Germany . |
| 2055936 | 5/1972 | Fed. Rep. of Germany . |
| 2264386 | 5/1973 | Fed. Rep. of Germany . |
| 2851006 | 6/1979 | Fed. Rep. of Germany . |
| 2908009 | 9/1979 | Fed. Rep. of Germany . |
| 8214363 | 9/1982 | Fed. Rep. of Germany . |
| 3507965C1 | 4/1986 | Fed. Rep. of Germany . |
| 3545885C1 | 1/1987 | Fed. Rep. of Germany . |
| 8802221 | 6/1988 | Fed. Rep. of Germany . |

*Primary Examiner*—Bernard Nozick

*Attorney, Agent, or Firm*—Barnes & Thornburg

[57] ABSTRACT

Consists essentially of a gun barrel (2) and a carrier (18) which can be fitted into a recess (20) on the rear, bottom end of the gun barrel (2), and of a voltage generator module (14). Formed in the gun barrel (2) is a first channel (10) for a fluid and above it, offset axially to the rear, a straight-line second channel (16) for accommodating the voltage generator module (14). A straight-line third channel (24) through the carrier (18) enables the connection of an electrical connector (40) to the primary side of the voltage generator module (14) by a simple plug connection, without disassembly of other parts. A straight-line fourth channel (25) in the carrier (18) communicates with the first channel (10). This makes all of the channels so short that all parts can be made from plastic without manufacturing problems and can be cleaned quickly.

12 Claims, 6 Drawing Sheets

Figures 1, 2:
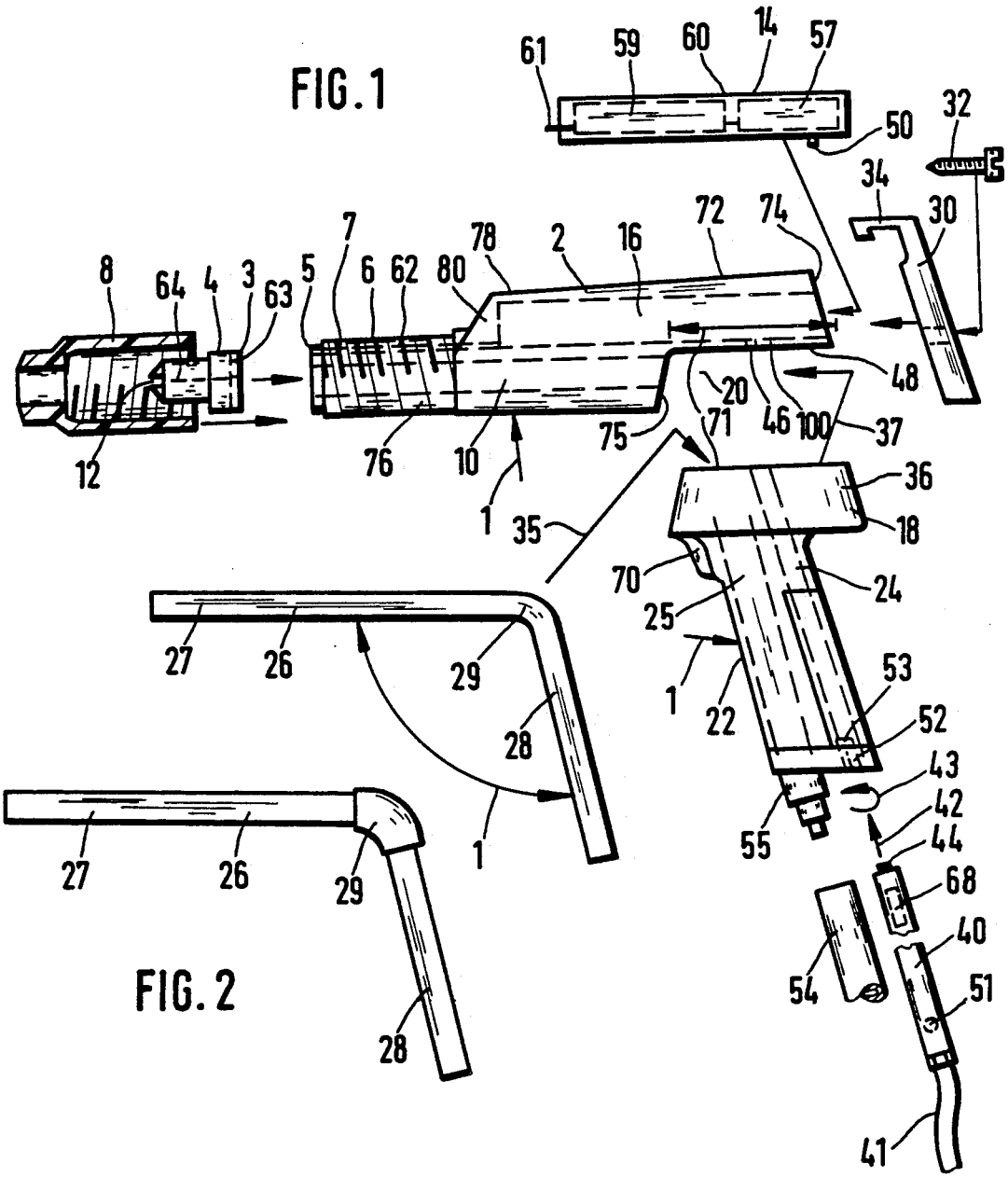

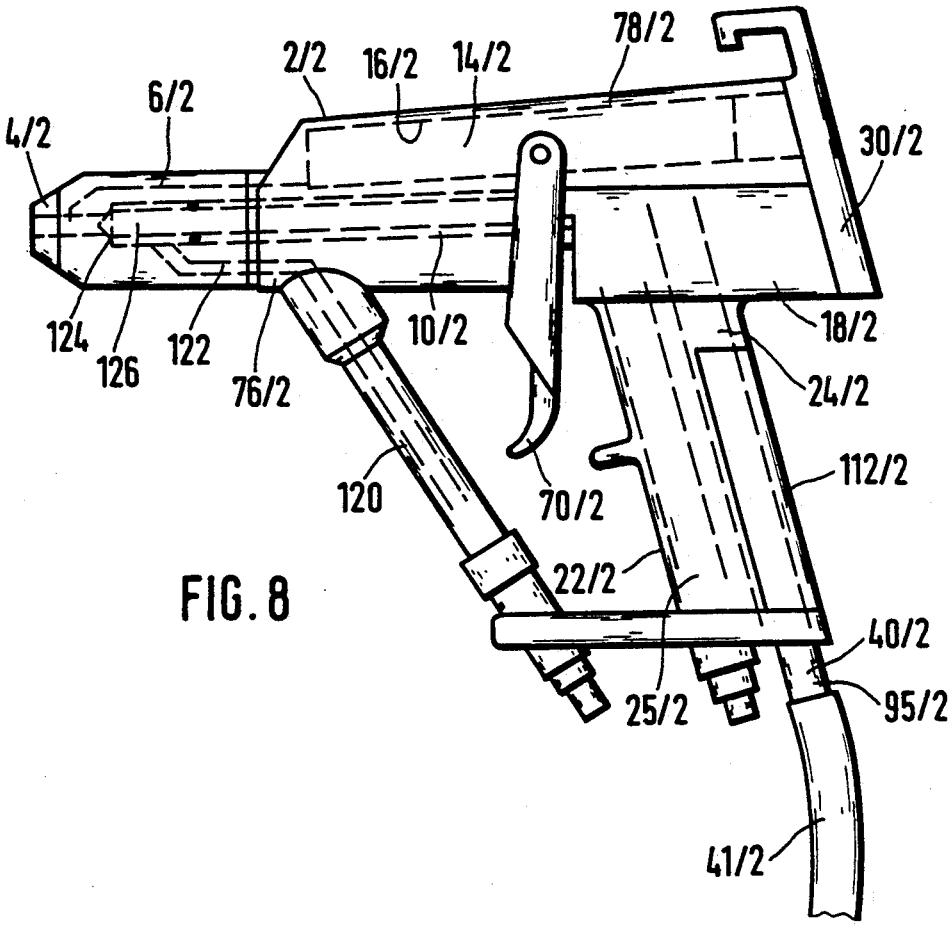
FIG. 8
FIG. 9
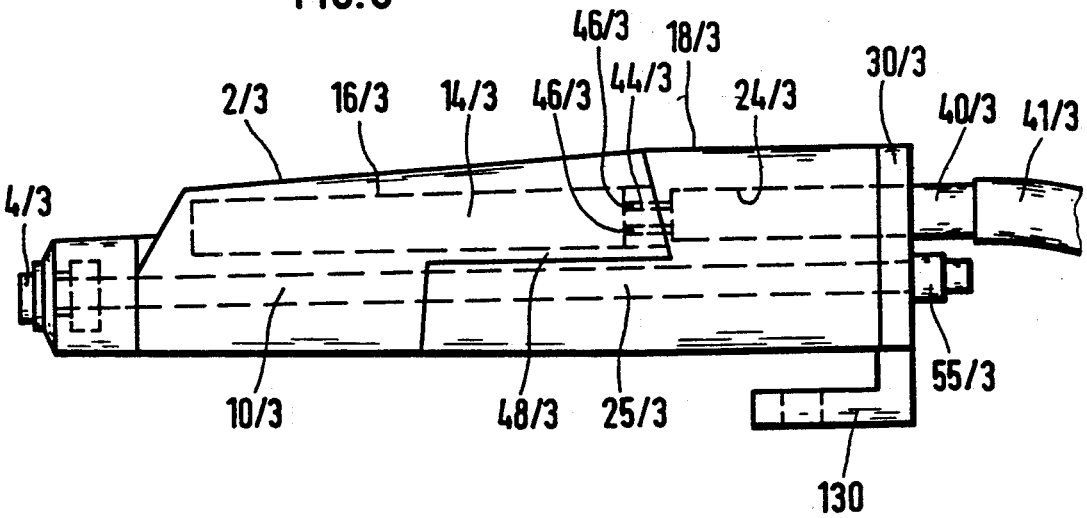

SPRAY COATING DEVICE FOR ELECTROSTATIC SPRAY COATING

The invention concerns a spray coating device for electrostatic spray coating of articles with a coating material.

A spray gun of this type known from the German patent document No. 28 51 006 (=U.S. Pat. No. 4,196,465) is comprised of a gun barrel and a carrier, attached to its underside, in the form of a gun grip. Extending through the gun barrel in the longitudinal direction is a straight channel for feeding powdery coating material to a spray nozzle. Through the channel there extends a straight plastic tube which at the rear protrudes beyond the channel and can be connected to a hose for supplying coating material. Beneath the channel and parallel to it, a second channel extends through the gun barrel. This second channel is forwardly sealed and can rearwardly be sealed as well by means of a cap. With the cap removed, a voltage multiplier cascade, a transformer and an oscillator can be successively introduced into the second channel, these being designed each as a module and connected with each other by means of electrical plugs as the modules are inserted in the second channel. Through the gun grip, from the bottom up, curves a channel through which electrical leads of a voltage supply cable are passed, which at the top protrude out of the gun grip and are connected to a connector plate which can be mated with the plug of the module inserted last. The gun grip can be unscrewed and the gun barrel can then be mounted, without gun grip, on a mechanized carrier, for instance a robot.

Known from the U.S. Pat. Nos. 3,617,000, 3,777,981 and 3,844,477 are spray guns where the fluid line consists of a flexible hose that extends from a supply for coating powder up to the spray gun and through it up to a spray nozzle.

The German patent document No. 34 02 945 proposes a voltage multiplier cascade to the secondary side of which there are electrodes connected for electrostatic charging of the coating material. A lamp indicates the electrical voltage of the electrodes. The European patent document No. 0 164 837 B1 proposes a spray gun for liquid coating material with a valve needle within a channel that extends through the gun barrel. The valve needle is actuated by a trigger and interacts with a valve seat which is arranged immediately before the spray nozzle. Here, too, a voltage multiplier cascade serves to generate a high voltage for electrodes for electrostatic charging of the liquid coating material. The European patent document No. 0 110 753 B1 teaches an electrostatic powder spray gun on which a grip borders on an overall flat backside of a gun barrel. Contained in the grip is a transformer, and a voltage multiplier is cast into the material of the gun barrel.

The problem underlying the invention is to so design the spray gun that it will enable a simpler manufacture, cleaning, maintenance and repair as well as an easy and quick exchange of major elements. Such an exchange of elements not only is intended to shorten operational downtimes in case of defective elements, but is to enable also the changeover of the spray gun from one spray system to another such as known, e.g., from the German patent disclosure No. 36 08 415. Moreover, the invention also is to enable a change of polarity of the high voltage from normally "minus" to "plus", such as required for instance for coating powder from polyamide.

The invention achieves a considerable reduction of the channels provided in the gun barrel and also of those in the gun grip. The gun barrel and the gun grip each consist essentially of a plastic body made by injection molding. If the tooling cores needed for the production of the channels in the plastic bodies are long and thin, there is a risk that they will sag during the injection molding process, leading to a deformation of the channels. This disadvantage is inventionally avoided. At the same time, the invention enables the observance of consistent wall thicknesses of the plastic bodies. The existence of varying wall thicknesses involves the risk that blowholes might form in the cooling process following the injection molding operation. The voltage generator consists of at least one module which in a simple way can be exchanged quickly. Inventionally, the module is accommodated, liquid-tight, in the spray gun barrel so that the gun barrel can be brought in contact with solvent for purposes of cleaning, along with the voltage generator contained in it, without causing damage to the latter. The plastic body into which the components of the voltage generator are cast, therefore, may consist of a plastic different from that of the spray gun barrel and, specifically, the plastic body need not be resistant to solvent. The carrier can be cleaned quickly as well, since the electrical connector of the low-voltage cable can be connected with the connecting elements of the voltage generator on the primary side by simply passing it through a straight-line channel of the carrier. Thus, all electrical connections are simple plug connections. The connector of the electrical feed cable only needs to be pulled out of the carrier for then removing the carrier in a simple way from the spray gun barrel for cleaning.

Coating material, specifically powder, has a greatly abrasive effect. Moreover, it is frequently desired to electrostatically charge the powder by friction on the wall of the line. Depending on powder type, other plastic materials are favorable as wall for the line. Inventionally, the tube can be exchanged easily and quickly once it has worn or when it is supposed to consist of a specific plastic or a specific other material or when in the case of a color change there is no time available for cleaning the tube.

Further characteristics of the invention are contained in the subclaims.

The invention will be explained hereafter with reference to the drawings with the aid of several embodiments serving as examples.

Figure 3:
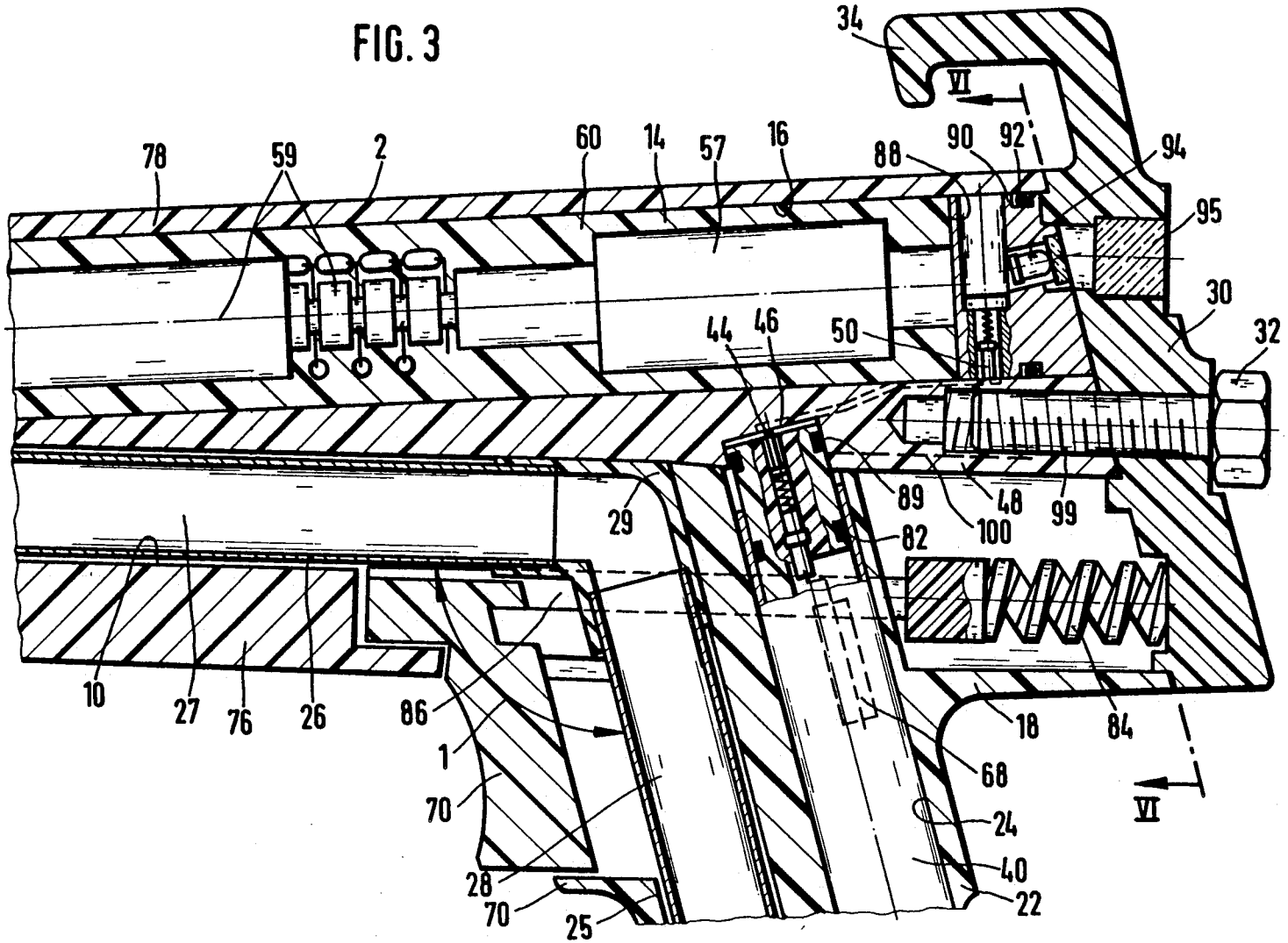
Figure 4:
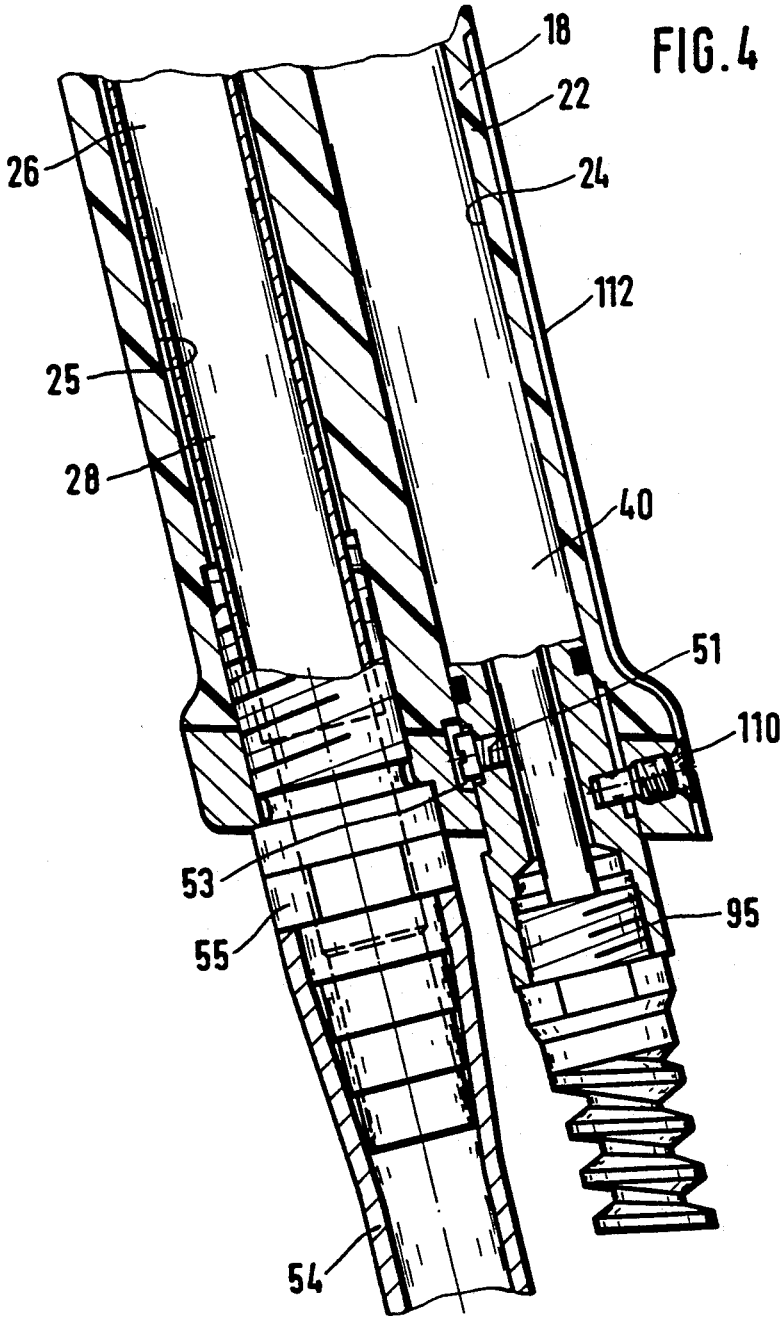
Figure 5:
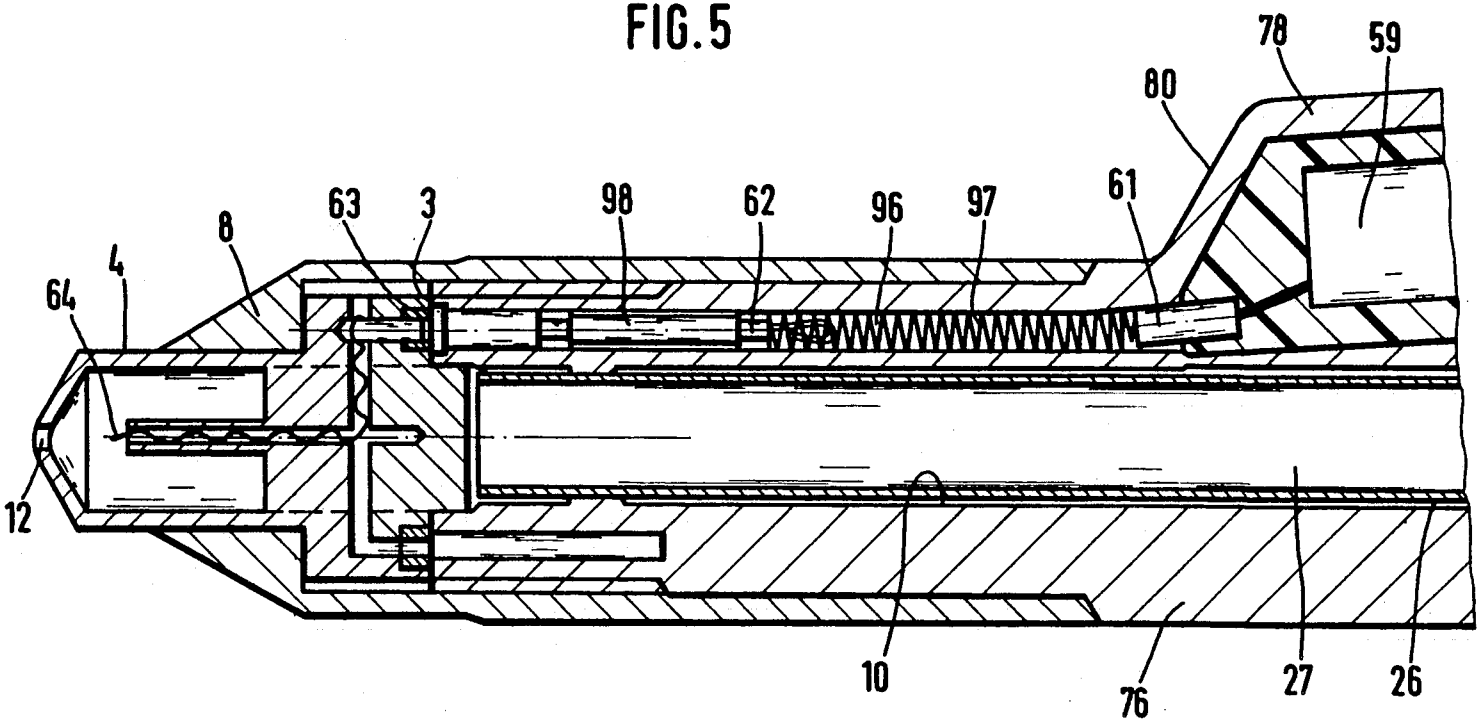
Figure 6:
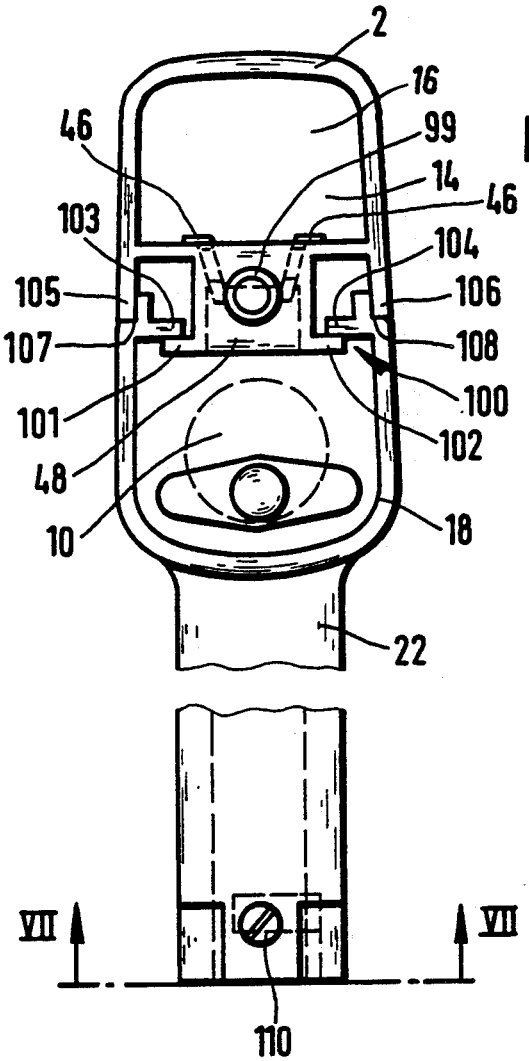
Figure 7:
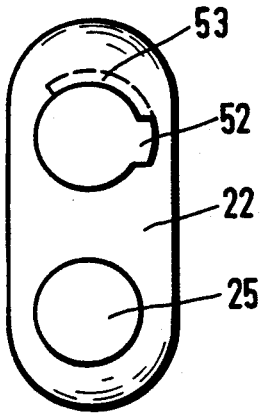

FIG. 1 shows an exploded view of an inventional spray gun;

FIG. 2, another embodiment of a tube according to FIG. 1;

FIG. 3, a longitudinal section, scaled up, of the central part of the spray gun relative to FIG. 1;

FIG. 4, a longitudinal section of the bottom part of a gun grip according to FIG. 1, scaled up the same as FIG. 3;

FIG. 5, a longitudinal section of the front half of the gun barrel relative to FIG. 1, scaled up the same as FIG. 3;

FIG. 6, a rear view along the plane VI—VI in FIG. 3 with a rear cap removed and a voltage generator module removed;

FIG. 7, a view from below, along the plane VII—VII in FIG. 6;

FIG. 8, another inventional embodiment of a spray coating apparatus for liquid coating material, specifically for enamel, and FIG. 9, a side elevation of another embodiment of an inventional spray coating device where a carrier of a spray gun barrel does not have a grip part but a mounting part for mounting the spray coating apparatus on a machine, specifically on a robot.

The inventional spray gun for electrostatic spray coating of articles with powdery coating material as illustrated in FIGS. 1 through 7 consists essentially of the following parts: a gun barrel 2 from plastic; a spray nozzle 4 from plastic whose rear, ring-shaped end phase 3 can be forced, airtight, on the forward end face 5 on the front end 6 by screwing a threaded sleeve that fits over the spray nozzle 4 and consists of plastic on the front end 6 of the gun barrel 2 that is provided with a threading 7, with a first straight-line channel 10 being aligned with the nozzle opening 12; a voltage generator 14 having the form of a module and being exchangeably insertable in a second straight-line channel 16 from the rear of the apparatus; a carrier in the form of a gun grip 18 which can be fitted into a recess 20 formed at the bottom rear in the gun barrel 2 and features a grip part 22, with the gun barrel 18 and its grip part 22 made jointly of one piece of plastic, and with a straight-line third channel 24 and parallel with it a straight-line fourth channel 25 extending through the gun grip 18, which two channels extend relative to the straight-line first channel 10 of the gun barrel 2 at an angle 1 between 90° and 140°; a plastic tube 26 extending as powder channel at the same angle as that between the first channel 10 and the fourth channel 25, so that the tube 26 has a shank 27 which essentially extends through the entire channel 10 and a shank 28 extending essentially through the entire length of the fourth channel 25; a rear cover cap 30 that can be fastened by a single screw 32 on the back of the gun barrel 2 and is provided, at the top, with a hook 34 for hanging the spray gun up. The cap 30 and its hook 34 consist integrally of plastic. The parts can be assembled in a simple way by inserting in accordance with arrow 35 the lower shank 28 of the tube 26 in the fourth channel 25 of the gun grip 18, then inserting the forwardly protruding shank 27 of the tube 26, from the gun back, into the first channel, thereby fitting the head part 36 of the gun grip 18 into the recess 20 of the gun barrel 2, according to arrow 37; the voltage generator 14 is fitted from the back of the gun into the second channel 16, with the option of installing the voltage generator 14 before or after the tube 26; next, the rear covering cap 30 is set in place and fastened with the screw 32; then a rod-shaped electrical connector 40 with a low-voltage supply cable 41 is passed, according to arrow 42, through the straight-line third channel 24 and then twisted about 90° according to arrow 43. In the process, electrical contacts 44 on the front end of the rod-shaped connector 40 are automatically forced on electrical connecting elements 46 that are cast in the intermediate bottom 48 of the gun barrel 2. Above the intermediate bottom 48, electrical contacts 50 of the primary side connection of the voltage generator 14 bear on the electrical connecting elements 46. The electrical contacts 44 and 50 have the form of resilient pins. The longitudinal motion 42 and subsequent motion 43 of the connector 40 causes a radially protruding projection 51 of this connector 40 in the third channel 24 to first engage the lengthwise groove 52 and then a groove 53 extending in peripheral direction, through which latter the connector 40 is positioned in the longitudinal direction of the third channel 24. A hose 24 for the feeding of powdery coating material can be connected with a socket 55 of the fourth channel 25. The disassembly of the spray gun relative to FIG. 1 takes place in reverse order and is required, e.g., when the spray gun needs to be cleaned or when the tube 26 is to be exchanged. The voltage generator 14 contains at least a transformer 57 and a voltage multiplier cascade 59, both of which are cast in a block 60 from plastic making the voltage generator 14 an exchangeable module. Fastened on the backside 88 of the block 60, which in FIG. 3 is the right-hand end, is a feed module 90. Electrical contacts 50 for the primary side electrical connection of the voltage generator 14 protrude out of the feed module 90. The voltage generator 14 forms together with the feed module 90 an exchangeable unit. The secondary end of the voltage multiplier cascade 59 is provided with an electrical connecting pin 61. The latter is connected, by way of an electrical line 62 extending through the front part 6 of the gun barrel 2 and by way of a ring-shaped electrical conductor 63 on the rear end face of the spray nozzle 4, with an electrode 64, electrically, which electrode is contained in the spray nozzle 4 and serves to electrostatically charge the powdery coating material. The voltage supplied to the electrical connecting elements 46 can be selectively activated or interrupted by a reed switch 68, which by a trigger 70 on the grip part 22 is magnetically remote-operated. The rear end of the second channel 16 can be hermetically sealed so that no liquid, specifically no solvent can proceed to the second voltage generator 14 housed in this second channel. The second channel 16 and the unit of voltage generator 14 and feed module 90 housed in it extend essentially parallel to the first channel 10, which is arranged underneath, but protrude rearwardly beyond the first channel because the gun barrel 2 is so graduated on its rear end 72, in length, that rearwardly, below the intermediate bottom 48, the recess 20 is located with the second channel 16 extending above the recess 20 up into an upper rearward plane 74, whereas the first channel 10 is located completely within the rearward plane 75 located beneath, which in FIG. 1 defines the left-hand end of the recess 20, the upper boundary of which is the intermediate bottom 48. This makes the first channel 10, which empties in the lower rearward plane 75, about 20% to 50% shorter than what it would be if it extended up into the plane of the upper rearward plane 74. The axial spacing 71 between the two rearward planes 74 and 75 corresponds to the upper axial length of the recess 20 and amounts to between 50% and 300%, preferably 150% of the axial length of the transformer 57. Based on the voltage generator module 14, it can be said that the axial spacing 71 ranges between 30% and 70%, preferably about 50% of the axial length of the voltage generator module 14. The front end of the gun barrel 2 provided with the threading 7 is coaxial with the first channel 10 and has only a minimal diameter, just as large as required for the threading 7 and for accommodating the electrical line 62. This makes the first channel 10 very short requiring only little plastic for forming the spray gun barrel alongside this first channel 10. As a result, no disadvantageous deformations of material are encountered in the manufacture. The lower barrel part forming the first channel 10 and the lower rearward plane 75 as well as the front part 6 with the threading 7 is marked 76. The upper barrel part 78 located above it extends from the upper rearward plane 74 up to a forward shoulder 80 that tapers into the front end 6 sufficiently far as required for forming the second channel 16 for housing the voltage generator 14 and its feed module 90.

According to the embodiment relative to FIG. 2, the tube 26 may be of a multiple part design. It consists preferably of plastic. The curved section 29 may be an elbow into which tubes are inserted as shanks 27 and 28. According to FIG. 3, the connector 40 of the voltage feed cable 41 has a tubular, electrically insulated sleeve 82 in which the reed switch 68 is accommodated. The trigger 70 moves against the force of a plastic spring 84 a rod-shaped magnet 86 relative to the reed switch 68 thereby turning the switch selectively on or off. The tubular or rod-shaped connector 40 extends up into a blind hole 89 formed in the intermediate bottom 48, thereby preventing the carrier 18 from being separated from the gun barrel 2 as long as the contacts 44 of the connector 40 are in connection with the electrical connecting elements 46 on the primary side of the voltage generator 14. The rear end 95 of the rigid connector 40 extends downwardly out of the grip part 22 according to FIG. 4 so that it can be gripped with the hand. The feed module 90 illustrated in FIG. 3 may be screwed onto the plastic block 60 of the voltage generator 14 or molded to it with plastic. This makes it possible to manufacture the plastic block 60 from a plastic material which is not resistant to solvent, which for casting the transformer 57 and the high voltage cascade 59 is more favorable, whereas the feed module 90 consists of a plastic that is resistant to solvent. The feed module comprises a lamp 94 indicating whether an electric voltage is present on the primary side of the voltage generator 14. A seal 90 is provided between the feed module 90 and the shell wall of the second channel 16.

From FIG. 5 it follows that in the electrical line 62 between the voltage generator 14 and the electrode 64 within a fifth channel 96 there are contained an electrically conductive spring 97 and an electrical load limiting resistor 98.

According to FIGS. 3 and 6, the screw 32 of the rear cap 30 is screwed into a threading 99 in the intermediate bottom 48. The screw 32 is made from plastic.

Especially from FIG. 6 it can be seen that between the carrier 18 and the gun barrel 2 a plug connection 100 is formed that extends in the longitudinal direction of the gun barrel. These two parts are axially plugged together at the plug connector as the gun grip 18 is inserted from right to left, according to arrow 37 in FIG. 1, into the recess 20 in the gun barrel 2. According to FIG. 6, the plug connection is formed by ribs 101 and 102 of the intermediate bottom 48 which transversely protrude away from each other, by ribs 103 and 104 of the carrier 18 that protrude toward each other and across the ribs 101 and 102, and by wall sections 105 and 106 of the upper barrel section that protrude downward, together with outer shoulders 107 and 108 of the gun grip 18 that extend lengthwise.

FIGS. 6 and 7, in conjunction with FIG. 4, show the quarter-turn catch 51, 52 and 53 of FIG. 1 in greater detail. As can be seen, the projection 51 of the electrical connector 40 may be formed by a screw. Also, the connector 40 may be secured by another screw 110 which at the same time may retain a grounding plate 112 on the back of the grip part 22.

The voltage generator module 14 is set back relative to the rear end, on the lower rearward plane 75 of the first channel 10, sufficiently far so that at least one-half the length of the transformer 57, but preferably the entire transformer 57, will be contained above the recess 20. All of the parts consist of electrically insulating plastic, except for the said electrical components and a grounding plate 112 on the back of the grip part 22 (FIG. 4).

The additional inventional embodiment illustrated in FIG. 8 in side view concerns a gun type spray coating apparatus for electrostatic spray coating of articles with a liquid coating material, specifically enamel. Parts which are identical or essentially similar to parts of the inventional embodiment described before have been given the same reference numerals with "/2" suffixed. The essential difference is that the liquid coating material, normally enamel, is not supplied to the straight-line first channel 10/2 at the upstream beginning, but through an additional enamel line 120 and an enamel channel 122 extending through the lower barrel part 76/2, in the front end 6/2, upstream from a valve seat 124 formed in the first channel 10/2. A valve needle 126 extends through the first channel 10/2, interacts with the valve seat 124 and is actuated by the trigger 70/2. The trigger 70/2 is pivotably connected with the gun barrel 2/2. The voltage generator module 14/2 is contained, here too, in the second straight channel 16/2 which is located above the first channel 10/2. Only the front half of the length of the second channel 16/2 is located directly above the channel 10/2, while the rear half or one-third of the second channel 16/2 protrudes rearwardly beyond the lower channel 10/2, which essentially is the case also with the embodiment described before with reference to FIGS. 1 through 7. The electrical connector 40/2 extends here as well through the straight-line third channel 24/2, from which it protrudes outwardly somewhat, as can be seen from FIG. 8, so that it can be gripped with the hand. In addition to the third channel, also the straight-line fourth channel 25/2 extends through the carrier 18/2 and its grip 22/2. This fourth channel 25/2, in FIG. 5, is required only when air is to be supplied for atomization of the liquid coating material. It is known though that the liquid coating material can be atomized also without the additional use of air, by the spray nozzle 4/2.

FIG. 9 shows an inventional embodiment not having a grip part 22 but instead a mounting bracket 130 for attachment of the spray coating apparatus to a machine, for instance a robot. Parts in FIG. 9 which are identical or essentially similar to parts of the first embodiment relative to FIGS. 1 through 7 are provided with the same reference numerals with "/3" suffixed. The mounting bracket 130 may be an integral extension of the rear covering cap 30/3. This straight-line first channel 10/3 and the second straight-line channel 16/3, located above it but axial offset relative to it, for the voltage generator module 14/3 and the other parts of the gun barrel 2/3 are essentially of the same design as the first embodiment described before. In the carrier 18/3, however, the straight-line third channel 24/3 is arranged axial to the second channel 16/3 and the straight-line fourth channel 25/3 axial to the first channel 10/3. Therefore, the primary side electrical connection elements 46/3 of the voltage generator module 14/3 are not contained in the intermediate bottom 48/3 but, according to FIG. 9, on the back of the module 14/3.

In FIGS. 8 and 9, additional elements that are identical or functionally essentially similar to elements of FIGS. 1 through 7 have been provided with reference numerals the same as in FIGS. 1 through 7, but with a suffix numeral.

Referenced in the claims are only the reference numerals of FIG. 1 through 7 of the first inventional embodiment because the other FIGS. 8 and 9, which contain additional embodiments of the invention, show the same reference numerals, which additionally are provided with suffix numerals "/2" or "/3".

I claim:

1. Spray coating apparatus for electrostatic spray coating of articles with coating material, with a gun barrel (2), with a spray nozzle (4) attached to the front end of the gun barrel, with a straight-line first channel (10) which extends axially to the spray nozzle through the gun barrel (2) and communicates with the spray nozzle (4), with a straight-line second channel (16) which extends through the gun barrel (2) from its rear end toward its front end, essentially parallel to the first channel (10), with a voltage generator (14) which is exchangeably inserted in the second channel (16), from the rear, and which consists at least of a transformer (57) located near the rear barrel end (74) and of a more forwardly situated voltage multiplier cascade (59), and features on the secondary side an electrical contact (61) by way of which it is electrically connected through an electrical conductor (62) with an electrode (64) serving to electrostatically charge the coating material, with a carrier (18) which detachably is fastened on the gun barrel (2), with a third channel (24), extending through the carrier (18), through which an electrical connector (40) of an electrical voltage supply cable (41) can be passed in order to detachably connect it electrically with the primary side electrical connectors (46, 50) of the voltage generator (14), wherein the rear end (74, 75) of the gun barrel (2) is in its length so graduated that its rear end features at the bottom a recess (20), in that the first channel (10) is located in the lower barrel part (76) of the gun barrel (2), which due to the recess is shorter than the remaining upper barrel part (78) of the gun barrel (2), in that the second channel (16) with the voltage generator (14) is located in the upper barrel part (78), which equal to the length of the recess (20) protrudes rearwardly beyond the lower part (76), in that the transformer (57) and the voltage multiplier cascade (59) of the voltage generator (14) are cast in a common plastic body which as a module is exchangeably arranged in the second channel (16), in that the voltage generator (14) extends within the second channel (16) with at least one-half the length of the transformer (57) rearwardly beyond the first channel (10), in that the second channel (16) is sealed liquid-tight at both of its ends (90, 92 at the rear end, end faces 3, 5 on the front end) so that no liquid can proceed to the voltage generator (14) in this second channel (16), in that a part (36) of the carrier (18) is fitted in the recess (20) at the bottom of the gun barrel (2), in that the third channel (24) extending through the carrier (18) and serving to accommodate the electrical connector (40) is straight, in that the connecting elements (46, 50) for the electrical connection of the primary side of the voltage generator (14) are relative to the inner end of the third channel (24) so arranged that they will automatically make contact with the electrical contacts (44) of the electrical connector (40) that are provided on the end of the connector (40), away from the voltage supply cable (41), as the connector (40) is passed from outside through the third channel (24), for which purpose the connector (40) is designed rod-shaped and stiff.

2. Spray coating apparatus according to claim 1, wherein the rod electrical connector (40) features a tubular sleeve (82, FIG. 3) from electrically insulating material and that this sleeve (82) houses a magnetically remote-operable reed switch (68) for selective interruption or activation of a control circuit with control relay or of an electrical connection from the cable (41) to the electrical contacts (44) of the connector (40).

3. Spray coating apparatus according to claim 1, wherein the carrier (18) features a grip part (22), in that in the carrier (18) there is a straight-line fourth channel (25) formed which extends through the carrier (18) and its grip part (22) at an angle in the range of 90° and 140° to the first channel (10) formed in the gun barrel (2), and in that a tube (26) extending angularly at the same angle is removably inserted with the one tube shank (28) in the fourth channel (25) in the carrier (18), and with the other tube shank (27) in the first channel (10) in the spray gun barrel (2), and in that the grip part (22) on the outer end of the fourth channel (25) is provided with connecting means (55) for connection of a line (54) for coating material.

4. Spray coating apparatus according to claim 3, wherein the rod electrical connector (40) features a tubular sleeve (82, FIG. 3) from electrically insulating material and that this sleeve (82) houses a magnetically remote-operable reed switch (68) for selective interruption or activation of a control circuit with control relay or of an electrical connection from the cable (41) to the electrical contacts (44) of the connector (40).

5. Spray coating apparatus according to claim 1, wherein the carrier (18) in the third channel (24) is provided with insert/twist/locking means (52, 53) into which the rod type electrical connector (40) in this third channel is inserted in the way of a quarter-turn catch and can then be positioned axially by a partial rotation, with this insert/twist movement at the same time establishing automatically an electrical connection of also the electrical contacts (44) of the connector (40) with the electrical connecting elements (46) leading to the primary side of the voltage generator (14).

6. Spray coating apparatus according to claim 5, wherein the rod electrical connector (40) features a tubular sleeve (82, FIG. 3) from electrically insulating material and that this sleeve (82) houses a magnetically remote-operable reed switch (68) for selective interruption or activation of a control circuit with control relay or of an electrical connection from the cable (41) to the electrical contacts (44) of the connector (40).

7. Spray coating apparatus according to claim 5 wherein the carrier (18) features a grip part (22), in that in the carrier (18) there is a straight-line fourth channel (25) formed which extends through the carrier (18) and its grip part (22) at an angle in the range of 90° and 140° to the first channel (10) formed in the gun barrel (2), and in that a tube (26) extending angularly at the same angle is removably inserted with the one tube shank (28) in the fourth channel (25) in the carrier (18), and with the other tube shank (27) in the first channel (10) in the spray gun barrel (2), and in that the grip part (22) on the outer end of the fourth channel (25) is provided with connecting means (55) for connection of a line (54) for coating material.

8. Spray coating apparatus according to claim 7, wherein the rod electrical connector (40) features a tubular sleeve (82, FIG. 3) from electrically insulating material and that this sleeve (82) houses a magnetically remote-operable reed switch (68) for selective interruption or activation of a control circuit with control relay or of an electrical connection from the cable (41) to the electrical contacts (44) of the connector (40).

9. Spray coating apparatus according to claim 1 or 5, wherein between the carrier (18) and the gun barrel (2) there is a mating connection (100, FIG. 6) formed that extends in the longitudinal direction of the gun barrel.

10. Spray coating apparatus according to claim 9 wherein the carrier (18) features a grip part (22), in that in the carrier (18) there is a straight-line fourth channel (25) formed which extends through the carrier (18) and its grip part (22) at an angle in the range of 90° and 140° to the first channel (10) formed in the gun barrel (2), and in that a tube (26) extending angularly at the same angle is removably inserted with the one tube shank (28) in the fourth channel (25) in the carrier (18), and with the other tube shank (27) in the first channel (10) in the spray gun barrel (2), and in that the grip part (22) on the outer end of the fourth channel (25) is provided with connecting means (55) for connection of a line (54) for coating material.

11. Spray coating apparatus according to claim 10, wherein the rod electrical connector (40) features a tubular sleeve (82, FIG. 3) from electrically insulating material and that this sleeve (82) houses a magnetically remote-operable reed switch (68) for selective interruption or activation of a control circuit with control relay or of an electrical connection from the cable (41) to the electrical contacts (44) of the connector (40).

12. Spray coating apparatus according to claim 9, wherein the rod electrical connector (40) features a tubular sleeve (82, FIG. 3) from electrically insulating material and that this sleeve (82) houses a magnetically remote-operable reed switch (68) for selective interruption or activation of a control circuit with control relay or of an electrical connection from the cable (41) to the electrical contacts (44) of the connector (40).

* * * * *